US010861275B2

(12) United States Patent
Hannawa et al.

(10) Patent No.: US 10,861,275 B2
(45) **Date of Patent: *Dec. 8, 2020**

(54) REVERSE VENDING MACHINE INCORPORATING A METHOD OF CLEANING THEREIN

(71) Applicant: Wael M. Hannawa, West Bloomfield, MI (US)

(72) Inventors: Wael M. Hannawa, West Bloomfield, MI (US); Ramize Sheena, West Bloomfield, MI (US)

(73) Assignee: Wael M. Hannawa, West Bloomfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/278,938

(22) Filed: Feb. 19, 2019

(65) Prior Publication Data

US 2019/0180551 A1 Jun. 13, 2019

Related U.S. Application Data

(63) Continuation of application No. 14/439,425, filed as application No. PCT/US2013/067310 on Oct. 29, 2013, now Pat. No. 10,210,693.

(Continued)

(51) Int. Cl.

*G07F 7/06* (2006.01)
*B30B 9/32* (2006.01)

(Continued)

(52) U.S. Cl.

CPC ..... *G07F 7/0609* (2013.01); *B07C 5/02* (2013.01); *B07C 5/122* (2013.01); *B07C 5/34* (2013.01);

(Continued)

(58) Field of Classification Search

CPC ..... G07F 7/0609; B30B 3/02; B30B 9/321; B30B 9/327; B07C 5/02; B07C 5/34; B07C 5/122; B08B 3/02

(Continued)

(56) References Cited

U.S. PATENT DOCUMENTS 4,223,966 A 9/1980 Winters
4,653,627 A 3/1987 Hampson et al.

(Continued)

FOREIGN PATENT DOCUMENTS

EP 0818303 A1 1/1998
FR 2644373 A1 9/1990

(Continued)

OTHER PUBLICATIONS

International Search Report dated Feb. 13, 2014 for International Application No. PCT/US2013/067310 filed Oct. 29, 2013.

*Primary Examiner* — Michael Collins
(74) *Attorney, Agent, or Firm* — Blue Filament Law PLLC

(57) ABSTRACT

A reverse vending machine is provided that includes an interface cabinet having an inlet portal. At least one bin is provided for receiving the accepted recyclable container. A roller system identifies and sorts the recyclable containers. A crusher is driven by a motor with a mechanical coupling between the crusher and the motor. The crusher is adapted to receive various containers and is positioned intermediate between the roller system and the bin. A cart or frame displaceable relative to the interface cabinet, the crusher is mounted on the cart or the frame. A reverse vending machine in another embodiment includes a interface cabinet, the interface cabinet having an inlet portal for recyclable container input and a rejected container depository. At least one bin and a roller system are provided along with a wash (Continued)

system for cleaning components of the interface cabinet between the inlet portal and the bin.

11 Claims, 8 Drawing Sheets

Related U.S. Application Data

(60) Provisional application No. 61/719,538, filed on Oct. 29, 2012.

(51) Int. Cl.
*B08B 3/02* (2006.01)
*B07C 5/02* (2006.01)
*B07C 5/12* (2006.01)
*B07C 5/34* (2006.01)

(52) U.S. Cl.
CPC ..... *B08B 3/02* (2013.01); *B30B 9/321* (2013.01); *B30B 9/327* (2013.01)

(58) Field of Classification Search
USPC ..... 700/231–244
See application file for complete search history.

(56) References Cited

U.S. PATENT DOCUMENTS 5,167,184 A 12/1992 Rebecchi
5,226,519 A * 7/1993 DeWoolfson ..... B65F 1/1405 194/209
5,361,913 A 11/1994 Melchionna
5,447,017 A * 9/1995 Becher ..... B09B 3/0025 53/121
5,465,822 A * 11/1995 DeWoolfson ..... G07F 7/0609 194/209
5,477,953 A 12/1995 Powell et al.
5,560,552 A 10/1996 Powell et al.
5,630,493 A 5/1997 DeWoolfson et al.
5,794,602 A 8/1998 Kimura
5,860,503 A 1/1999 Hanserud et al.
5,918,721 A * 7/1999 Weinberger ..... G07F 7/0609 194/208
5,934,440 A * 8/1999 Kroghrud ..... B07C 5/126 194/212
5,988,054 A 11/1999 Wieglus
6,575,290 B2 6/2003 Loning et al.
7,180,026 B1 2/2007 Guntveit et al.
7,754,990 B2 7/2010 Saether
7,908,031 B2 3/2011 Saether et al.
8,112,858 B2 2/2012 Robles
8,718,818 B2 5/2014 Nordbryhn
8,851,265 B2 * 10/2014 Morishita ..... B08B 3/02 194/208
9,731,845 B2 8/2017 Petrini
10,210,693 B2 * 2/2019 Hannawa ..... B30B 9/321
2003/0010598 A1 * 1/2003 Kiva ..... B07C 5/3412 194/208
2004/0184651 A1 * 9/2004 Nordbryhn ..... G07F 7/0609 382/142
2004/0190765 A1 * 9/2004 Tvinnereim ..... B07C 5/3422 382/142
2007/0292117 A1 * 12/2007 Saether ..... G01N 21/8806 396/20
2008/0223758 A1 9/2008 Scheeres
2008/0306813 A1 12/2008 Romansky
2011/0145173 A1 * 6/2011 Hunscher ..... G06Q 10/30 705/500
2011/0238598 A1 9/2011 Borowski et al.
2012/0029980 A1 * 2/2012 Paz ..... B07C 5/34 705/14.1
2012/0173014 A1 7/2012 Morishita et al.
2014/0147005 A1 * 5/2014 Kavli ..... G06T 7/0002 382/103
2014/0210967 A1 * 7/2014 Kirkerud ..... G06K 9/78 348/61
2014/0218510 A1 8/2014 Nordbryhn

FOREIGN PATENT DOCUMENTS

JP 2875863 B2 3/1999
RU 14686 U1 8/2000

* cited by examiner

REVERSE VENDING MACHINE INCORPORATING A METHOD OF CLEANING THEREIN

RELATED APPLICATIONS

This application is a continuation of U.S. Non-provisional application Ser. No. 14/439,425 filed Apr. 29, 2015; now U.S. Pat. No. 10,210,693B; that in turn is a U.S. National phase of PCT/US2013/067310 filed Oct. 29, 2013; that in turn claims priority benefit of U.S. Provisional application Ser. No. 61/719,538 filed Oct. 29, 2012; the contents of the aforementioned are hereby incorporated by reference.

FIELD OF THE INVENTION

Embodiments of the present invention generally relate to the recycling of containers and cans. More particularly, the present invention relates to machines, automated or otherwise, for returning and redeeming deposits from recyclable containers and cans with the ability to be cleaned easily or which implement a self-cleaning method.

BACKGROUND

Since the 1970's it was recognized that purely disposing of household and industrial garbage was inefficient, a waste of space, and harmful to the environment. The methods employed largely relied on the use of landfills and incinerators. Landfills were quickly filling, and vast spreads of land were quickly becoming occupied or protected. Similarly, incinerator emissions were being heavily regulated to reduce the release of materials that were toxic to either humans, the environment or all of the above.

It was quickly recognized that a major contributor to the volume of garbage were storage containers for foods and beverages. Typically these containers are made from aluminum, plastics, paper or glasses which are all recyclable. Although many volunteer efforts were established for recycling the bulk of recyclables still remained to be discarded into the normal trash pathways, ending up in the landfills and incinerators.

In an effort to promote recycling, many states have enacted legislation which requires that beverage containers carry a redemption deposit as a technique for encouraging recycling of such redeemable and recyclable containers. When the customer purchases a product in such a container, a container deposit, typically one to five cents, is added to the purchase price. After consumption of the product, the consumer can obtain a refund of the deposit by returning the empty container, often to the retailer, for recycling. The amount of the deposit may be adjusted to create an incentive for returning the container that is greater than the inconvenience in doing so. In these states, retailers generally collect the used containers and sell them to distributors or others who pay the retailer for the scrap value of the containers plus an amount to cover the retailer's handling costs.

In the past, segregation of returned containers has been labor intensive, so that the labor to perform the sorting can sometimes cost more than the increase in resale value of the segregated material. Retail outlets, which often must act as redemption centers, have had to utilize personnel to sort and count returned containers so that such containers could be returned to the proper distributor for redemption. This arrangement has required devotion of an inordinate amount of personnel time, and an inordinate proportion of the available floor space spawning the development of small and automated reverse vending machines for receiving, sorting, and in some cases, crushing the returned recyclables, while providing some form of a monetary deposit refund, or a coupon for redemption to the customer redeeming the deposit on the recyclables.

While many reverse vending machines have been developed, none have provided a solution for dealing with the smell and non-recyclable waste that accompanies these machines at their retail locations. Few customers rinse the recyclables prior to returning them to the retail location for redemption, thus when an automated machine is used the process of sorting the bottles or crushing the cans and/or plastics causes the remnants, often sugary, to spill from their container into the internal components of the reverse vending machine, into the deposited recyclable storage container, and often the remnants spill out to the retail floor surrounding the machines. These spilled remnants not only cause bug problems, sanitary problems and smell problems, but they also present liability problems in the form of slip and fall injuries.

To remedy these issues, many stores have to dedicate personnel to keep close watch and frequently clean these areas to help reduce liability, reduce bug infestation and improve sanitation and smell. However, because a good amount of the spilled remnants are retained in the machine, the problems often persist until the machines finally break from corrosion or obstruction of the remnants. Some machines have been employed which provide access panels which allow for cleaning the internal components, however it is difficult, and often futile, for the cleaning employee to reach around motors, gears and electrical wires and components. These methods not only do nothing to reduce the amount of personnel time required to monitor the recycling areas in retail stores, but they actually increase the chance for an employee to get hurt by having to reach around these electrical and mechanical parts.

There thus remains an unmet need for a reverse vending machine that may be thoroughly cleaned, thus reducing the unsavory smells and unsanitary conditions that often accompany a container recycling area in a retail store while reducing employee time. There also remains an unmet need for a reverse vending machine which automatically cleans itself, thus removing the need, altogether, of using up a retail stores employees.

SUMMARY OF THE INVENTION

A reverse vending machine is provided that includes an interface cabinet having an inlet portal for recyclable container input and a rejected container depository. At least one bin is provided for receiving the accepted recyclable container. A roller system identifies and sorts the recyclable containers. A crusher is driven by a motor, a mechanical coupling is between the crusher and the motor. The crusher is adapted to receive a plastic bottle container, an aluminum can container, or a combination thereof, and positioned intermediate between the roller system and the at least one bin. A cart or frame displaceable relative to the interface cabinet, the crusher is mounted on the cart or the frame.

A reverse vending machine in another embodiment includes at least one interface cabinet, the interface cabinet having an inlet portal for recyclable container input and a rejected container depository. At least one bin is provided for receiving the accepted recyclable container. A roller system identifies and sorts the recyclable containers. A wash system is provided for cleaning components of the interface cabinet between the inlet portal and the at least one bin.

BRIEF DESCRIPTION OF THE DRAWINGS

It should also be understood that the following figures are merely illustrative and may not be drawn to scale.

DETAILED DESCRIPTION OF THE INVENTION

Figure 1A:
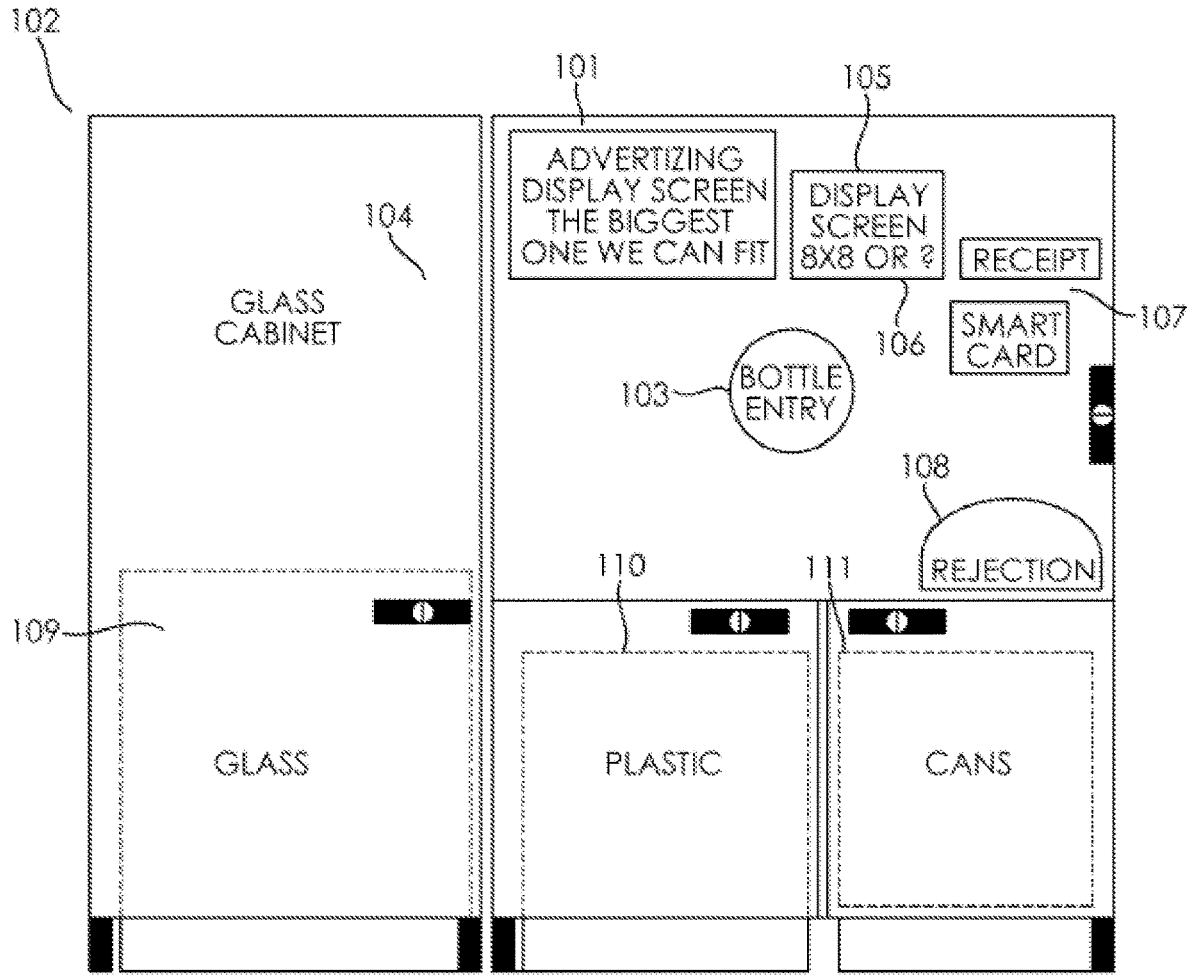
FIG. 1A is a front view of an inventive embodiment of a reverse vending machine.
Figure 1B:
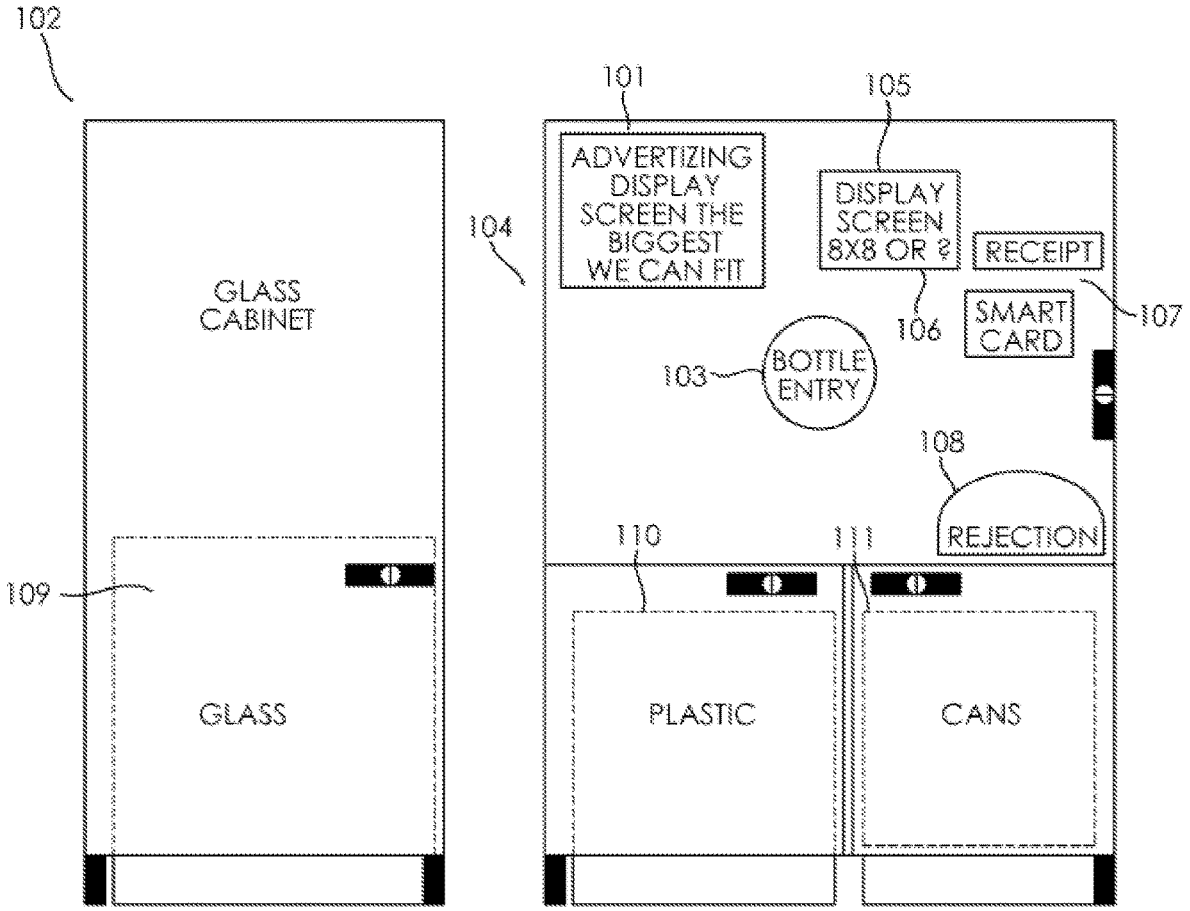
FIG. 1B is an additional front view of the reverse vending machine of FIG. 1A showing the separation of a glass cabinet from an interface cabinet allowing full access to each for ease of cleaning.

The following detailed description is merely exemplary in nature and is not intended to limit the invention or the application and uses of the invention. Furthermore, there is no intention to be bound by any expressed or implied theory presented in the preceding technical field, background, or the following detailed description.

An inventive reverse vending machine has conventional structures and logic for separating, counting and crushing beverage containers while also providing for access to the crusher system components for thorough cleaning of the internal components and chassis. As a result the present invention promotes the elimination of odor, bacteria, bug infestation and preventing corrosion of internal parts.

As shown with respect to FIGS. 1A, 1B, 2, and 3, an inventive reverse vending machine is shown generally at 100 and has at least one interface cabinet 101 having a portal 103 for recyclable container input and a rejected container depository 108. Conventional components in the interface cabinet 101 are known to art as shown for example in U.S. Pat. No. 4,653,627; and US 2003/0010598. At least one bin is provided for receiving the accepted recyclable container, and as shown, a glass bin 109, a plastics bin 110 and a bin for aluminum are present.

A reverse vending machine 110 in some embodiments includes a graphical user interface (GUI) or simple display 105. The GUI or simple display 105 indicates to the user information illustratively including that related to the refunding of deposits for the recyclable materials including, but not limited to, instructions for operating the machine and/or redeeming credits, tallying the amount and/or types of recyclable containers counted, tallying the amount of refund due, providing an option to donate the deposit owed, or other information that may be useful or desired to inform the user. The reverse vending machine 100 in some embodiments has an advertising display 104 used for advertising selected by a machine owner, a retail store, or otherwise. It is appreciated that the GUI or simple display 105 is readily used in a machine 100 alone, or in combination with the advertising display 104. In still other embodiments of the inventive reverse vending machine 100, a receipt dispenser 106, a smart card scanner 107, or a combination thereof are present to facilitate provision of a credit based on the number or recyclable containers redeemed for deposit value.

Figure 2:
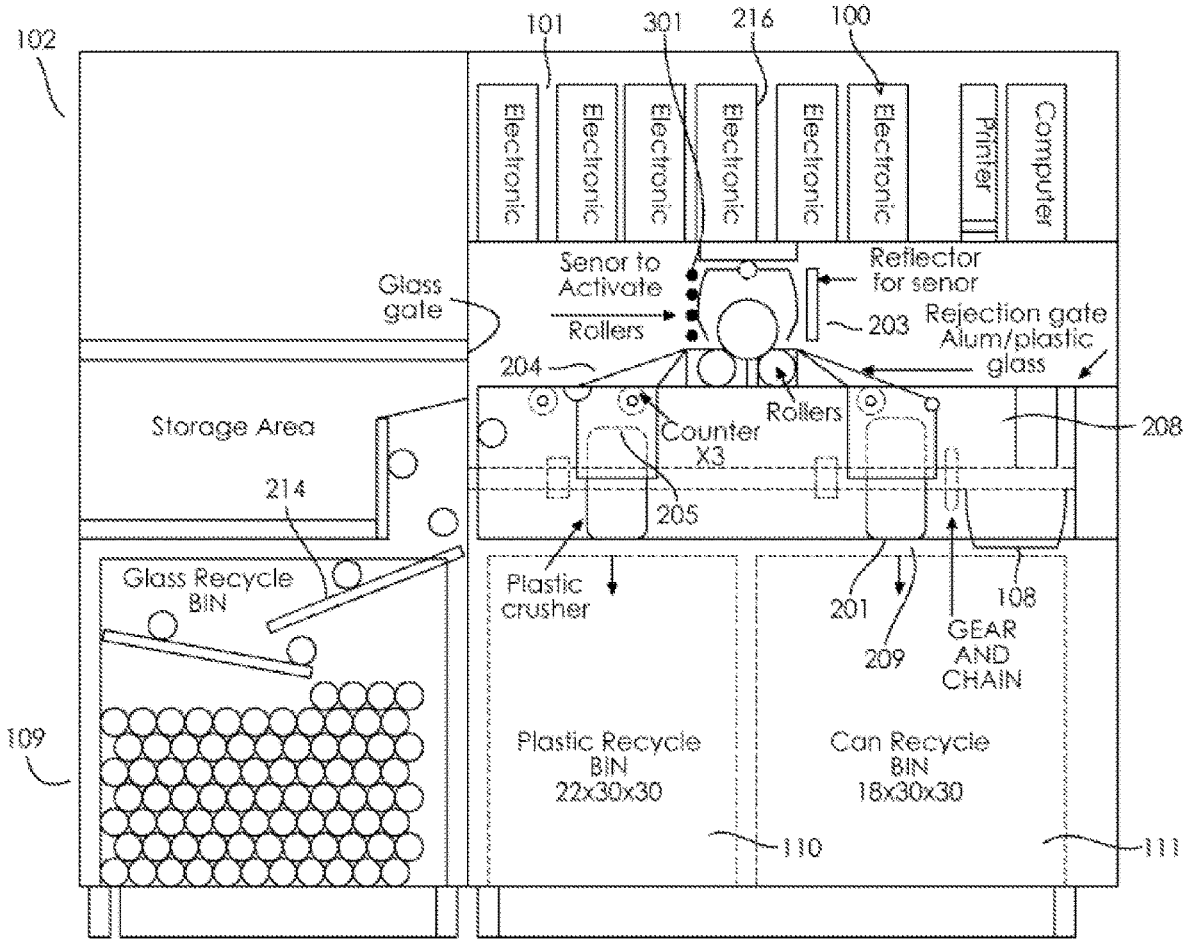
FIG. 2 provides an internal front view of the reverse vending machine of FIG. 1A.

As best seen in FIG. 2, a reverse vending machine 100 has an interface cabinet 101 capable of accepting sorting and storing plastic bottles or aluminum cans or a combination thereof. In still other embodiments, a reverse vending machine has a removable cabinet 102 containing a glass storage bin 109 and a conveyance system shown generally at 214 for the movement of glass containers from the recyclable container input portal 103 to a glass container bin 109.

Figure 3:
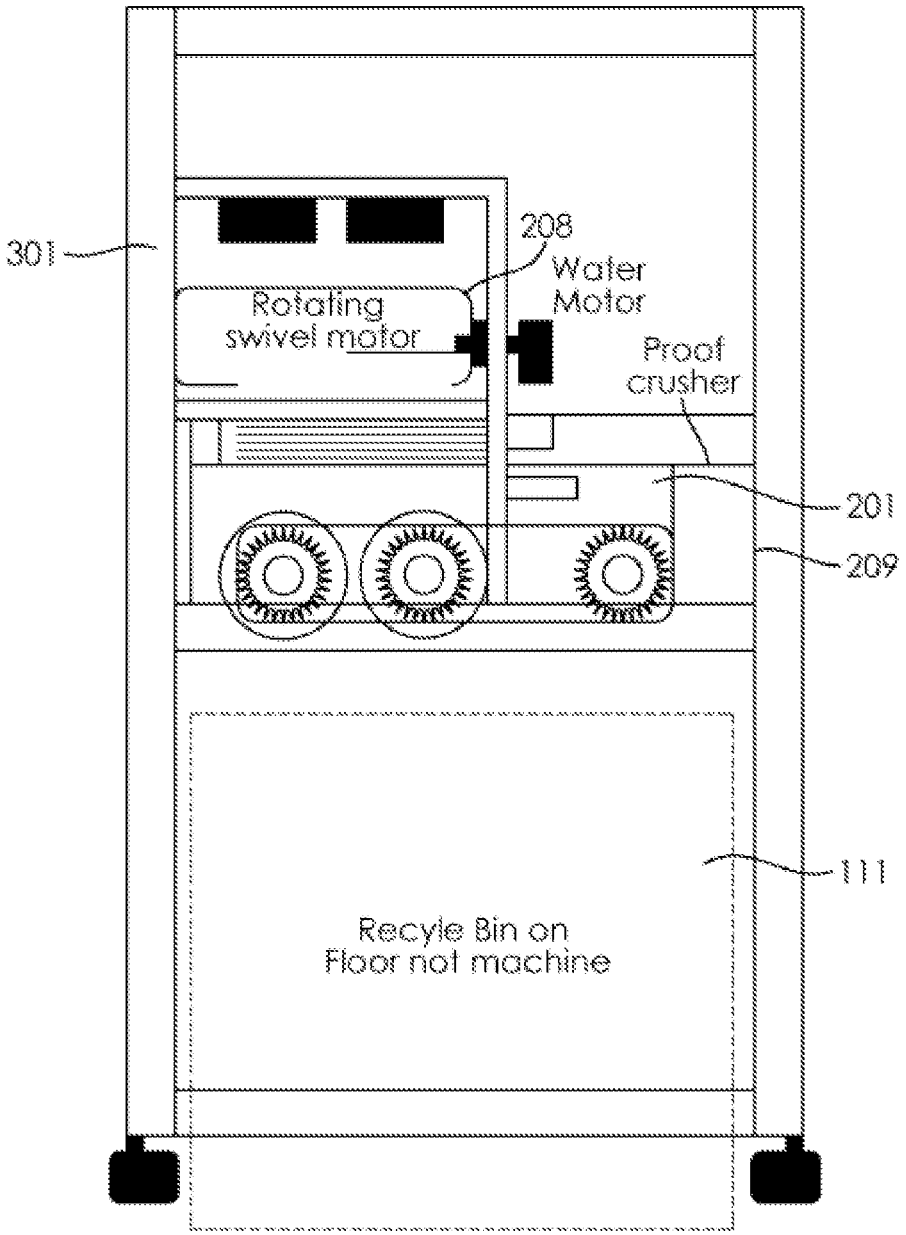
FIG. 3 is an open side view of the reverse vending machine of FIG. 1A.

As best seen in FIGS. 2 and 3, a roller system for scanning and binning the input recycled containers. The roller system includes at least one motor driven roller 207, at least one sensor to activate rollers 204, at least one sensor reflector 203, as are conventional to the art. A scanner 301 reads the bar code from a recyclable container bar code as the container is in contact with the roller 207 with scanner data used to assess acceptance or rejection of the container, and can be used for other purposes such as market research and gauging consumer behavior. While FIG. 3 is a cross sectional view showing the can crusher 201 and bin 111, a similar view exists for the plastic bottle side containing crusher 202 and bin 110. The machine 100 is programmed to preselect a specific container, else the container in some embodiments is exhausted via rejection gate 206 to the rejection depository 108. A counter 205 provides data as to the number of recycled containers input into the machine 100. Count data is used for various purposes in machine 100, illustratively including calculating deposit return value, notification of the need for bin emptying feeding, market research, and combinations thereof. The roller system components are under the control of electronics that are shown generally at 216. An accepted aluminum can or plastic bottle is then fed by machine 100 to a respective can crusher 201 or plastic crusher 202. A crusher 201 or 202 is powered by a crusher motor 208 by a mechanical coupling 209 to at least one of the crushers 201 or 202. The mechanical coupling 209 is depicted as a gear and chain drive in the accompanying figures, although it is appreciated that various other forms of couplings 209 are operative herein including a direct drive shaft, belt assembly, rack and pinion, or transmission. The crushers 201 or 202 in operation become fouled with the liquid contents of can and bottle containers that have been accepted by the machine 100. Container content often never dries and quickly lead to an unhygienic and inefficient operation. The present invention addresses this problem by providing machines 100, 400, and 600 that are configured for ease of cleaning to prevent accumulation of container contents, especially on the crushers 201 or 202.

Figure 4A:
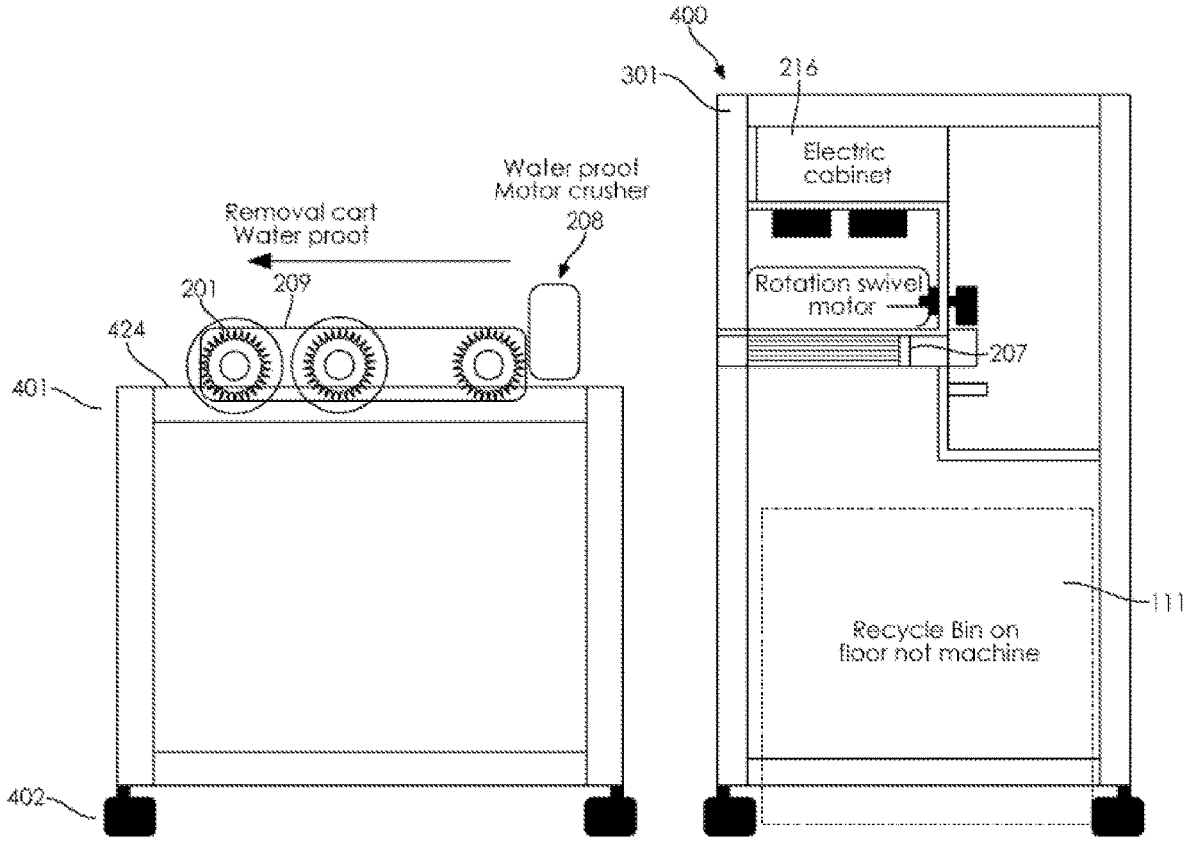
FIG. 4A is an open side view of another embodiment of an inventive reverse vending machine with a crusher that is cart mounted.
Figure 4B:
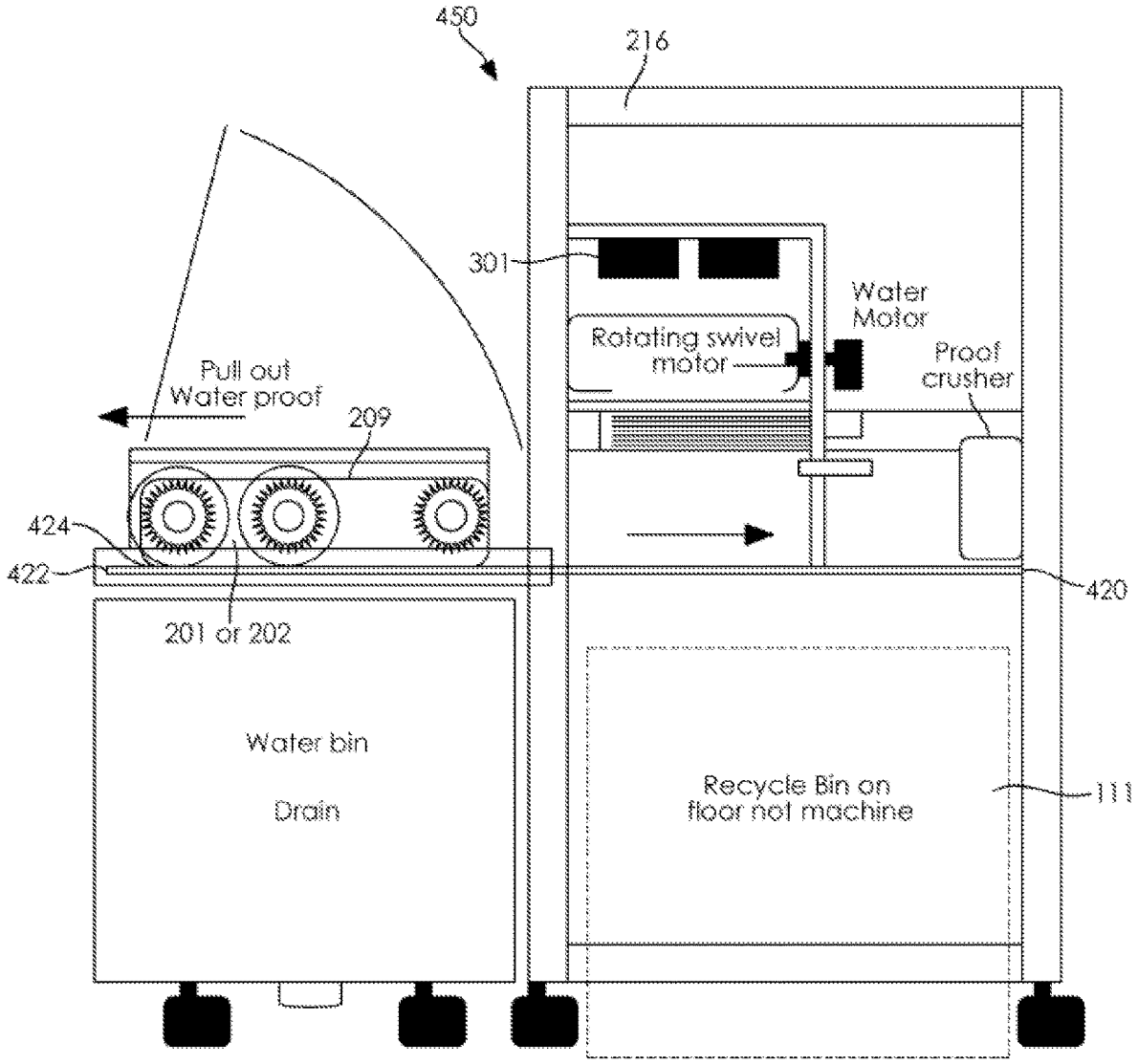
FIG. 4B is an open side view of another embodiment of an inventive reverse vending machine with a crusher that is glide mounted.

As shown in FIGS. 4A and 4B, an inventive reverse vending machine is provided generally at 400 and 450, respectively, where like numbered components have the same meaning as those aspects detailed with respect to FIGS. 1A, 1B, 2, and 3 for those same numerals; some aspects of machine 100 are not shown with respect to machine 400 for visual clarity. In machine 400, at least crusher 201 or 202 is mounted to a cart 401 that is displaced from the cabinet 101 assembly cabinet for cleaning. In other embodiments, the cart 401 has wheels 402 to facilitate movement relative to the cabinet 101. In still other embodiments, a hydraulic cylinder urges the cart 401 into the cabinet 101, out of the cabinet 101, or a combination thereof. The cart 401 is readily formed for steel, aluminum, plastics, or fiberglass. In still other embodiments the mechanical coupling 209, alone or in combination with the motor 208 are also mounted on the cart 401 to facilitate cleaning of these components as well. In some embodiments, the cart 401 is configured to be displaced without having to move bin 111. In operation, cart 401 is displaced to allow for cleaning of cart mounted components of a crusher 201 or 202, the mechanical coupling, motor, or a subset thereof, as well as to for cleaning of the roller system via portal 103 and the void created by displacement of the cart 401. A catch basin placed under a displaced cart 401 facilitates washing of cart-mounted components, as well as service followed by replacement of cart 401 in the cabinet 101.

As shown in FIG. 4B, roller glides 420 mounted to the cabinet 101 support a retractable frame 422 on which the crusher 201 or 202 is mounted. As shown in FIG. 4B that provide for pull out of the crusher 201 or 202 to facilitate cleaning and servicing. In some embodiments, a pivot 424 is provided that allows the angle of a crusher 201 or 202 to be changed relative to the frame 424 or cart 401. A water bin having a basin is shown in FIG. 4B for context and is used with a hose to collect waste water from washing frame or cart mounted components.

Figure 5:
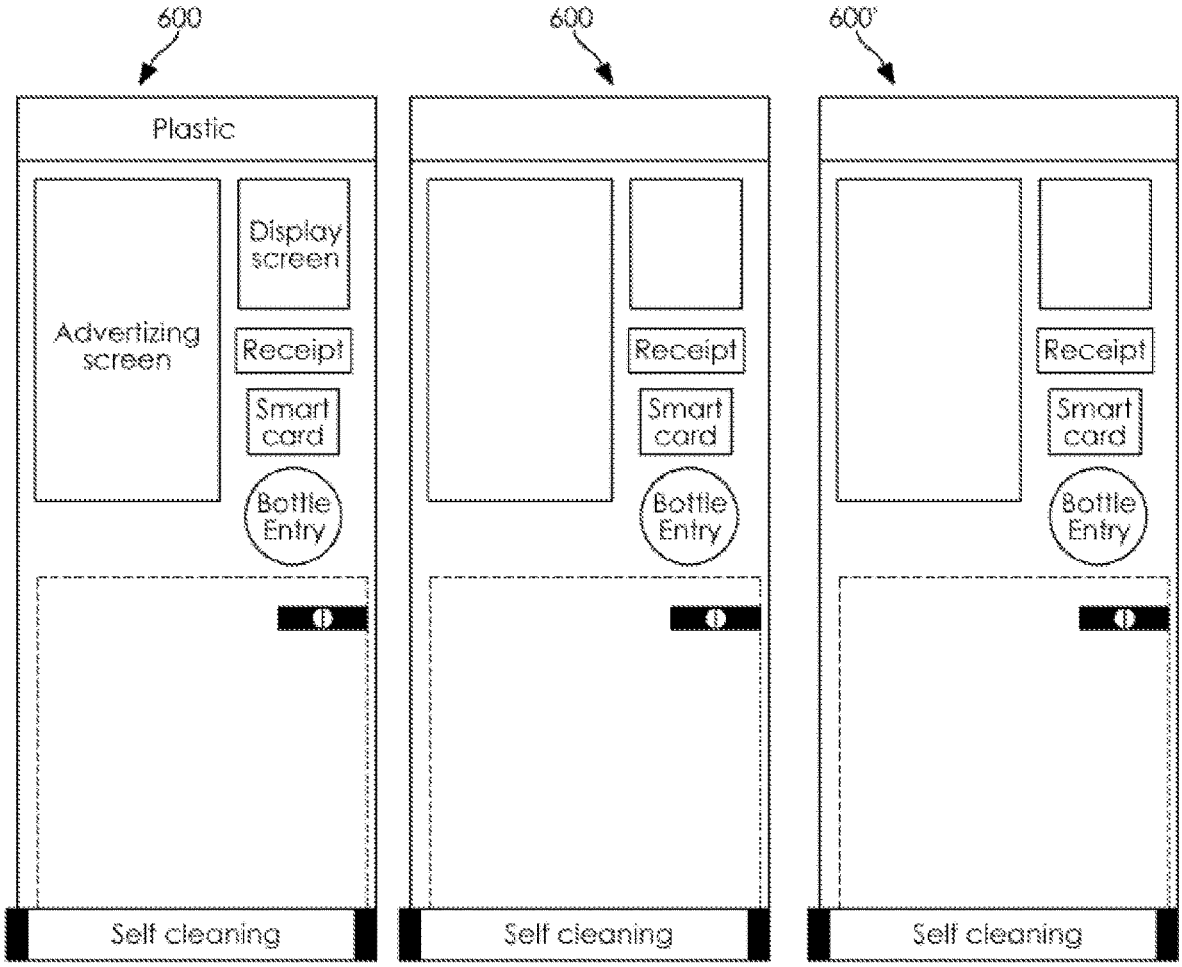
FIG. 5 is a front view of a third embodiment of an inventive reverse vending machine illustrated as three separate inventive machines each for handling a different recyclable material.
Figure 6:
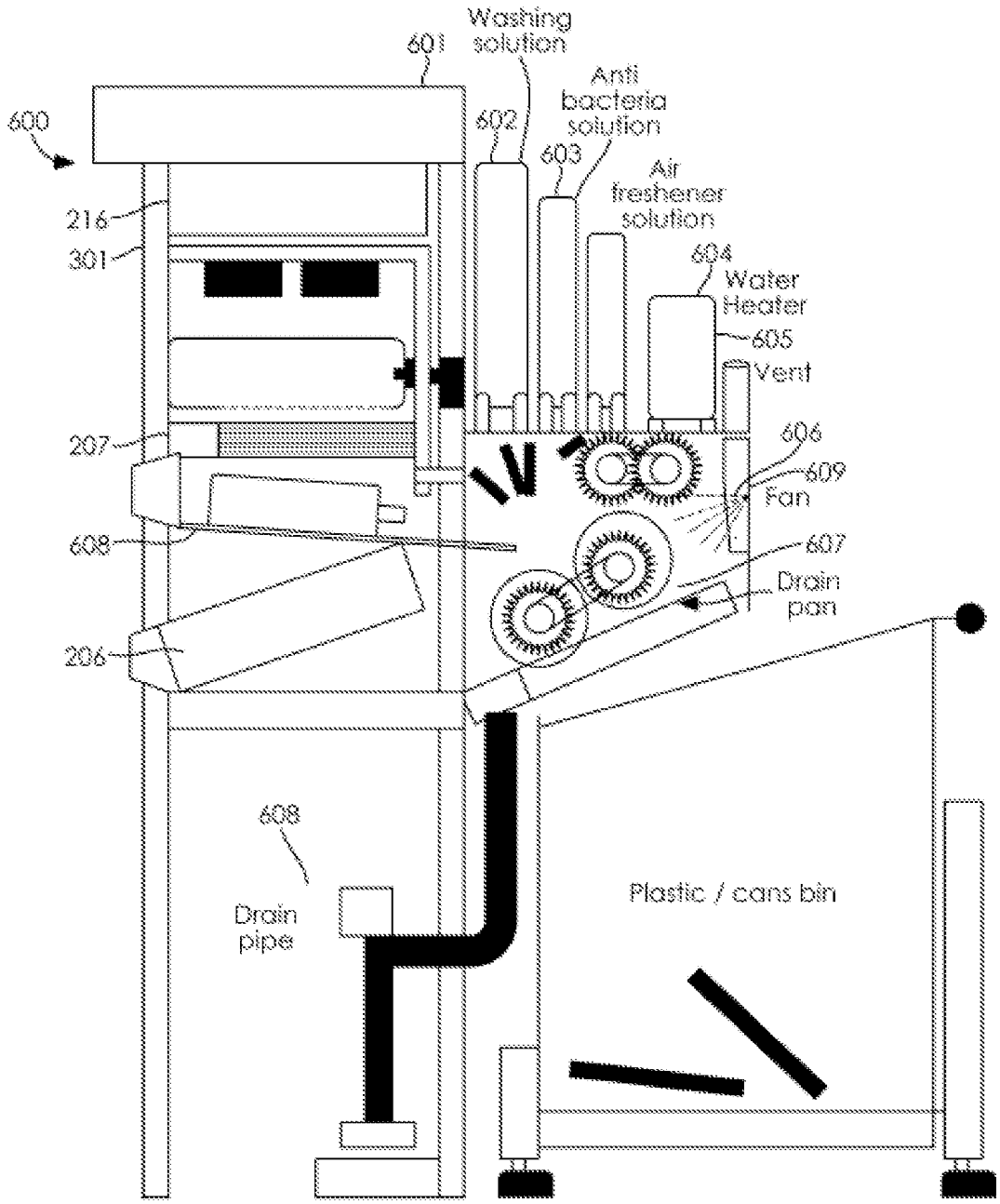
FIG. 6 is a cutaway view of a fourth embodiment of reverse vending machine.

FIG. 5 depicts a row of inventive reverse vending machines with one each of plastic bottles, cans, each shown generally at 600, where like numbered components have the same meaning as those aspects detailed with respect to FIGS. 1A, 1B, 2, and 3 for those same numerals. It should be appreciated that with the except of a glass container machine lacking a crusher system, the machine depicted for glass reception at 600' is otherwise comparable to machines 600. In the embodiments depicted in FIGS. 5 and 6, the container if being accepted drops onto a translator 608 such as a slide or a conveyer belt to deliver the container to a motor driven crusher 609. It is appreciated that a swing translator having a side to side motion in a machine 600 allows such as machine 600 to sort various containers and delivery them to a preselected crusher in the case of plastic bottle or metal can, or in the case of a glass container to a bin without crushing. A glass container passing into a collection bin nonetheless benefits from the cleaning that is performed by a self-cleaning system as detailed herein with respect to machine 600. A rejected container is returner to the user via rejection gate 206 to the rejection depository 108.

The machine 600 has at least one of a washing solution storage 601, an anti-bacterial compound storage vessel 602, an air freshener storage vessel 603 are in fluid communication with the crusher 609 to clean or deodorize the crusher. In other embodiments, all of the washing solution storage 601, the anti-bacterial compound storage vessel 602, the air freshener storage vessel 603 are present. It is appreciated that all such vessels discharge contents sequentially or in concert in an aqueous solution to self-clean the area around crusher 609 that is prone to being splashed by recycled container contents. A lipped drain pan 607 and a drain 608 are present to discharge cleaning solutions preferentially over filling a container collection bin 610 for either plastic bottles or aluminum cans. A lipped drain pan 607 channels liquid to the drain 608, as opposed to allowing aqueous solution to spill into the bin 610. It is appreciated that other configurations of spraying the internal area between the roller system and bin 610 are operative to selectively collect and drain the washing solution into the drain 608. In other embodiments, a water heater is provided to generate hot water or steam to facilitate cleanings and effectiveness of active cleaning substances stored in any of the vessels 601, 602, or 603, as present. A vent 605 is present in some embodiments, alone or in combination with a fan 607 to facilitate drying of the crusher 609 and the surrounding area.

Other embodiments may include all the above features in addition to, a self-cleaning system for the reverse vending machine including at least one washing solution a drain to remove the washing solution. The washing solution may be, but should not be limited to, any cleaning agent associated with cleaning remnants typically associated with recyclable containers including washing solutions such as water (hot or cold), soap, alcohol, powder, bleach, chlorine or a combination thereof. Other embodiments featuring the self-cleaning contents may contain other elements such as an anti-bacterial solution alone or in combination with the washing solution, an air freshening solution, a water heater, a vent, a fan, a drain pan, or a drain pipe. An inventive reverse vending machine may contain all of the above contents for self-cleaning, or may contain only a few of the elements.

It should be appreciated that any embodiment of the reverse vending machine shall contain water proof components and wiring to prevent the spilled remnants from affecting the operation of the machine, and allowing for water or other solutions to be used for cleaning without causing excess wear or damage to the machine components. For instance, water proof motors should be used which are typically encased in a water resistant material a transferring excess heat to heat contents for cleaning the system, or a fin for removing heat through the heat transfer capabilities of the water resistant material. It is appreciated that metal components are readily provided with coatings which prevent corrosion or damage from water and/or spilled remnants from binding any gears thus affecting the operation of the machine or any of it components.

The drawings and diagrams shown herein depict example arrangements of elements of the device and method. More or less than all the features available or contemplated may be present in an actual embodiment.

The inventive machine 100, 400, or 600 is used for sorting crushing and storing recyclable materials at a retail location. A user inserts a recyclable container into the recyclable container input portal. The container is then spun on the roller, scanned and sorted for the material type and to determine whether the container has a deposit credit or otherwise it is conveyed to the recyclable container input portal. Once the recyclable container is classified and accepted it is conveyed to, in the event of plastic or cans, the appropriate crusher whereby the appropriate crush motor is activated until the recyclable material is crushed, as indicated by a predetermined force or down position sensor of either the motor or crusher, then the crushed container is release to the repository container for the respective recyclable material. Where the recyclable container is glass, the glass container is conveyed to the appropriate glass container bin hopefully without breaking the glass recyclable container.

Once full, or upon a routine maintenance and emptying of the reverse vending machine, the glass cabinet and interface cabinets are opened by a retail employee or other personnel responsible for the cleaning and/or maintenance of the machine or responsible for the recovery of the recyclable material. The maintenance person is able to separate the glass cart from the interface cart, and remove the removable carts from each assembly thereby exposing the internal components of the reverse vending machine to allow for ease of cleaning spills from the recyclable container remnants and providing maintenance to the machine. Upon completion of cleaning and/or maintenance the container repositories are removed and replaced with empty container repositories, the recyclable material is transferred to its respective recycling yard, and the machine is returned to service.

Upon retail store employee demand, or a predetermined program, a washing solution is first sprayed throughout the internals of the reverse vending machine to aide in the removal of any spilled remnants from the sorting or crushing of the recyclable containers. A water heater is used to heat an incoming water source for rinsing away the washing solution containing the washed off spilled remnants. A drain pan and assists in collecting the water and washing solution and directing the water and washing solution to a drain pipe. A fan and vent is then used to assist in the drying of the internal components after the washing and rinsing cycles are complete.

Other self-cleaning programs include the use of an anti-bacterial solution and/or an air freshening solution to be used in conjunction with or in succession of the washing and rinsing to remove any odor or odor causing bacteria internal to the machine. Where an anti-bacterial solution or air freshener is used, the drain pan and drain pipe also assist for their removal.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

The invention claimed is:

1. A reverse vending machine located in a retail store comprising:

an interface cabinet having an inlet portal for recyclable container input;

a graphical user interface (GUI) or simple display associated with said interface cabinet, said GUI or simple display adapted to display information as to instructions for operating the reverse vending machine, redeeming credits based on an amount of recyclable containers deposited, the amount of recyclable containers including a combination of plastic bottle containers and aluminum can containers, tallying the amount of recyclable containers counted, tallying types of the recyclable containers counted, tallying the amount of refund due based on an amount of recyclable containers deposited, and providing an option to donate the refund due;

a roller system for identifying and sorting recyclable containers;

a crusher driven by a motor with a mechanical coupling between said crusher and said motor, said crusher adapted to receive a plastic bottle container, or an aluminum can container, or a combination thereof from said roller system;

at least one bin for receiving a crushed plastic bottle container, or an aluminum can container, or a combination thereof from said crusher; and wherein the reverse vending machine is configured for self-service by a user in the retail store.

2. The reverse vending machine of claim 1 wherein the interface cabinet further comprises at least one of a smart card reader, an advertising display, a receipt printer, or any combination thereof.

3. The reverse vending machine of claim 1 wherein said roller system comprises at least one roller motor, at least one roller, at least one sensor to activate rollers, at least one reflector for the roller activating sensor, at least one counter and at least one scanner for scanning the recyclable containers or their bar codes.

4. The reverse vending machine of claim 1 further comprising a glass cabinet having a glass container bin for receiving glass containers from said interface cabinet.

5. The reverse vending machine of claim 1 further comprising a wash system in for spraying an area intermediate between said roller system and said at least one bin, said wash system having at least one washing compound storage vessel in fluid communication with the area as a washing solution, and a drain to remove the washing solution after cleaning.

6. The reverse vending machine of claim 5 wherein said vessel contains contents of at least one of a washing compound, an anti-bacterial, an air freshener, or a solution; said vessel further comprising at least one of a nozzle for dispersing or dispensing the contents, at least one water heater, at least one vent, at least one fan, at least drain pan, or at least one drain pipe.

7. The reverse vending machine of claim 6 wherein the contents for cleaning the internal components of the interface cabinet and an optional glass cabinet comprise at least one washing solution, the nozzle for dispersing or dispensing the washing solution and a drain to remove the washing solution after cleaning.

8. The reverse vending machine of claim 6 further comprising a lipped drain pan.

9. The reverse vending machine of claim 1 further comprising a pivot to change an angle of said crusher relative to said cart or said frame.

10. The reverse vending machine of claim 1 further comprising a cart or frame displaceable relative to said interface cabinet, said crusher mounted on said cart or said frame.

11. The reverse vending machine of claim 10 further comprising wheels on said cart.

* * * * *